US010468749B2

(12) United States Patent
Lu et al.

(10) Patent No.: US 10,468,749 B2
(45) Date of Patent: Nov. 5, 2019

(54) MOBILE DISPLAY TERMINAL

(71) Applicant: BOE TECHNOLOGY GROUP CO., LTD., Beijing (CN)

(72) Inventors: Yongchun Lu, Beijing (CN); Jian Xu, Beijing (CN); Xinyin Wu, Beijing (CN); Yong Qiao, Beijing (CN); Jianbo Xian, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 5 days.

(21) Appl. No.: 14/915,613

(22) PCT Filed: Sep. 29, 2015

(86) PCT No.: PCT/CN2015/091078

§ 371 (c)(1),
(2) Date: Feb. 29, 2016

(87) PCT Pub. No.: WO2016/155275

PCT Pub. Date: Oct. 6, 2016

(65) Prior Publication Data

US 2017/0040669 A1 Feb. 9, 2017

(30) Foreign Application Priority Data

Apr. 3, 2015 (CN) ..... 2015 2 0200997 U

(51) Int. Cl.

| | |
|---|---|
| ***H01Q 1/24*** | (2006.01) |
| ***H01Q 1/38*** | (2006.01) |
| ***H01Q 21/28*** | (2006.01) |

(52) U.S. Cl.
CPC ..... *H01Q 1/243* (2013.01); *H01Q 1/38* (2013.01); *H01Q 21/28* (2013.01)

(58) Field of Classification Search
CPC H01Q 1/243; H01Q 1/38; H01Q 1/50; H01Q 21/28
See application file for complete search history.

(56) References Cited

U.S. PATENT DOCUMENTS 7,217,898 B2 * 5/2007 Chien ..... H01H 23/14 200/339
2006/0170597 A1 * 8/2006 Kurashima ..... H01Q 1/22 343/700 MS (Continued)

FOREIGN PATENT DOCUMENTS

CN 101500381 A 8/2009
CN 201467180 U 5/2010

(Continued)

OTHER PUBLICATIONS

International Search Report and Written Opinion in PCT International Application No. PCT/CN2015/091078, dated Jan. 6, 2016.

*Primary Examiner* — Robert Karacsony
(74) *Attorney, Agent, or Firm* — Brooks Kushman P.C.

(57) ABSTRACT

The present disclosure provides a mobile display terminal, including a case, a main board and an antenna. The main board is arranged inside the case, a circuit board is arranged on the main board, and the antenna is arranged on the case. The mobile display terminal further includes a connector configured to electrically connect the antenna to the circuit board.

9 Claims, 6 Drawing Sheets

(56) References Cited

U.S. PATENT DOCUMENTS

| | | | | |
|---|---|---|---|---|
| 2008/0074329 | A1* | 3/2008 | Caballero | H01Q 1/088 343/702 |
| 2009/0002242 | A1 | 1/2009 | Lasarov et al. | |
| 2012/0249383 | A1* | 10/2012 | Hsu | H01Q 1/243 343/720 |
| 2014/0184451 | A1* | 7/2014 | Kuo | H01Q 1/243 343/702 |

FOREIGN PATENT DOCUMENTS

| | | | |
|---|---|---|---|
| CN | 102142598 | A | 8/2011 |
| CN | 102686060 | A | 9/2012 |
| CN | 102821570 | A | 12/2012 |
| CN | 202616397 | U | 12/2012 |
| CN | 102869217 | A | 1/2013 |
| CN | 204441445 | U | 7/2015 |

* cited by examiner

MOBILE DISPLAY TERMINAL

CROSS-REFERENCE TO RELATED APPLICATION

The present application is the U.S. national phase of PCT Application No. PCT/CN2015/091078 filed on Sep. 29, 2015, which claims a priority of the Chinese patent application No. 201520200997.5 filed on Apr. 3, 2015, which is incorporated herein by reference in its entirety.

TECHNICAL FIELD

The present disclosure relates to the field of display technology, in particular to a mobile display terminal.

BACKGROUND

Along with the repaid development of the modern commercial mobile communication technology, such portable mobile display terminals as mobile phones and tablet computers have been widely used. As a primary device of wireless communication, the portable mobile display terminal is provided with an antenna for receiving signals. In the related art, there are mainly two arrangement modes of the antenna. In a first mode, the antenna is arranged in a separate manner relative to the mobile display terminal, while in a second mode, the antenna is integrated into a printed circuit board (PCB) of the mobile display terminal.

However, for the mobile display terminal in the related art such as a mobile phone, according to the first mode, the appearance of the mobile phone will be adversely affected and the separate antenna will easily be damaged, i.e., a structural integrity will be adversely affected. According to the second mode, usually it is required to provide two antennae inside the mobile phone, and the space for the antennae inside the mobile phone will be extremely constrained, resulting in a relatively large design difficulty. In addition, when the second mode is adopted, electromagnetic interference may occur between the antennae and wires of the PCB, so the reception of the signals may be adversely affected.

SUMMARY

An object of the present disclosure is to provide a mobile display terminal, so as to prevent the occurrence of the electromagnetic interference between the antennae and the wires of the PCB, thereby to improve the reception of the signals.

The present disclosure provides in some embodiments a mobile display terminal, including a case, a main board and an antenna. The main board is arranged inside the case, a circuit board is arranged on the main board, and the antenna is arranged on the case. The mobile display terminal further includes a connector configured to electrically connect the antenna to the circuit board.

Alternatively, the antenna is arranged within, and completely covered by, the case.

Alternatively, the antenna is arranged within the case, with a part of the antenna being exposed at an outer surface of the case.

Alternatively, the antenna is arranged on an outer surface or an inner surface of the case.

Alternatively, a functional button is further arranged on the case and configured to be pressed by a user so as to control the mobile display terminal manually. The functional button serves as the antenna. The connector is an elastic member capable of generating elastic deformation, arranged on the functional button, and configured to electrically connect the antenna to the circuit board all the time when the functional button is pressed or restored to its initial state.

Alternatively, a contact point is arranged at a position of the circuit board corresponding to the connector, and the connector is electrically connected to the circuit board via the contact point.

Alternatively, one or more antennae are provided, and an amount and positions of the contact points correspond to an amount and positions of the antennae.

Alternatively, the antennae are arranged at at least one side surface of the case.

According to mobile display terminal in the embodiments of the present disclosure, e antenna is arranged on the case and electrically connected to the circuit board via the connector. As a result, the space for the antenna inside the mobile phone may be saved, so as to reduce the design difficulty and prevent the occurrence of the electromagnetic interference between the antenna and the wires of the circuit board, thereby to improve the reception of the signals.

BRIEF DESCRIPTION OF THE DRAWINGS

The following drawings, as a part of the specification and together with the following embodiments, are for illustrative purposes only, but shall not be used to limit the scope of the present disclosure.

DETAILED DESCRIPTION OF THE EMBODIMENTS

The present disclosure will be described hereinafter in conjunction with the drawings and embodiments. It should be appreciated that, the following embodiments are for illustrative purposes only, but shall not be used to limit the scope of the present disclosure.

The present disclosure provides in some embodiments a mobile display terminal, which includes a case, a main board, an antenna and a connector. The main board is arranged inside the case, a circuit board is arranged on the main board, the antenna is arranged on the case, and the connector is configured to electrically connect the antenna to the circuit board. According to the embodiments of the present disclosure, the antenna is arranged on the case and electrically connected to the circuit board via the connector. As a result, the space for the antenna inside the mobile phone may be saved, so as to reduce the design difficulty, and prevent the occurrence of the electromagnetic interference between the antenna and the wires of the circuit board, thereby to improve the reception of the signals.

First Embodiment

Figure 1A:
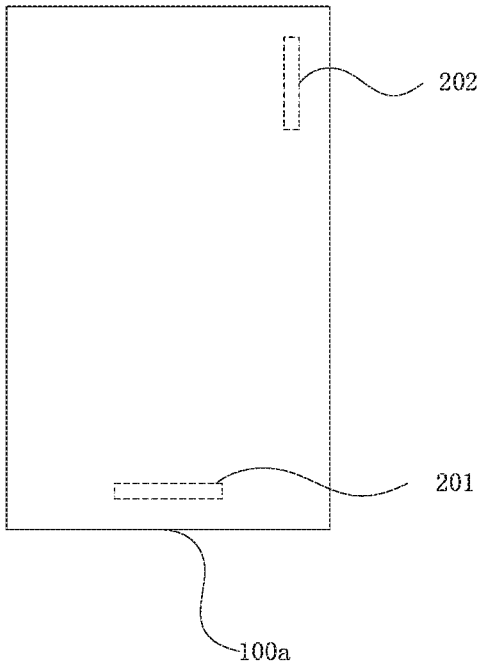
FIG. 1A is a schematic view showing an outer surface of a case of a mobile display terminal according to the first embodiment of the present disclosure.
Figure 1B:
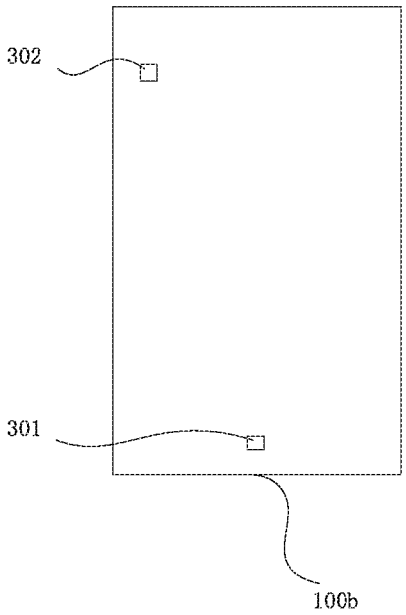
FIG. 1B is a schematic view showing an inner surface of the case of the mobile display terminal according to the first embodiment of the present disclosure.
Figure 1C:
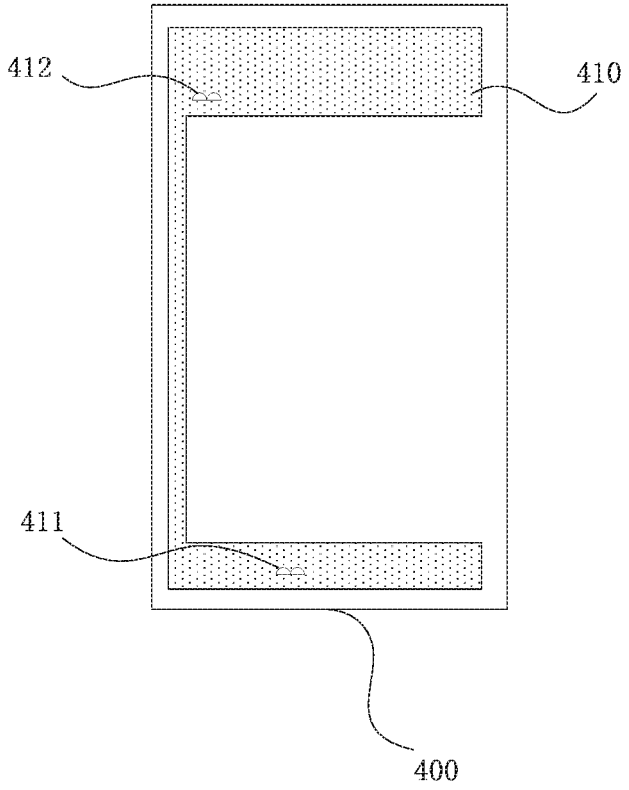
FIG. 1C is a schematic view showing a main board of the mobile display terminal according to the first embodiment of the present disclosure.
Figure 1D:
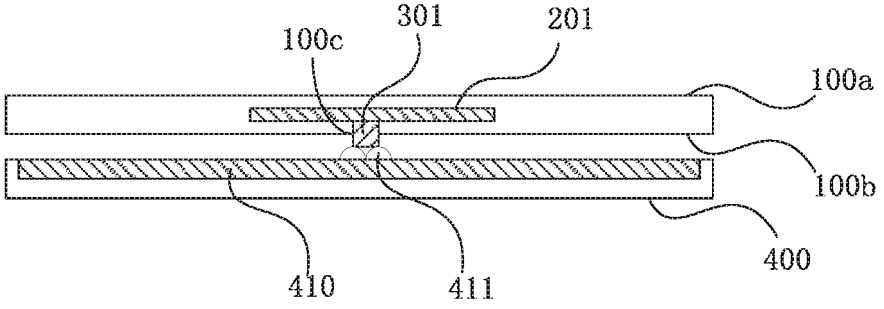
FIG. 1D is a sectional view of the mobile display terminal according to the first embodiment of the present disclosure.

Referring to FIGS. 1A-1D, the mobile display terminal in this embodiment includes a case (including an outer surface 100*a*, an inner surface 100*b* and two holes 100*c*, 100*c*'), a main board 400, two antennae 201, 202, and tow connectors 301, 302. As shown in FIG. 1D, the main board 400 is arranged inside the case, a circuit board 410 is arranged on the main board 400, and the circuit board 410 is arranged at a side of the main board 400 opposite to the inner surface 100*b* of the case. The two antennae 201, 202 are arranged on, and completely covered by, the case. The two connectors 301, 302 are made of a conductive material such as copper, arranged on the case and at positions corresponding to the two antennae 201, 202, and electrically connected to the two antennae 201, 202, respectively. During the practical application, a size and a position of each antenna may be set randomly in accordance with such factors as strength of the received signal, and the two connectors are arranged at positions of the case corresponding to the two antennae respectively.

In addition, two contact points 411, 412 are arranged at positions of the circuit hoard 410 corresponding to the two connectors 301, 302, respectively. The two connectors 301, 302 are electrically connected to the circuit board 410 via the two contact points 411, 412 respectively, so as to electrically connect the two antennae 201, 202 to the circuit board 410.

It should be appreciated that, in this embodiment, the two connectors 301, 302 are each protruded from the inner surface 100*b* of the case. However, the present disclosure is not limited thereto, and during the practical application, the two connectors may also be in flush with the inner surface of the case, or depressed relative to the inner surface of the case, as long as the connectors may be effectively in electrical contact with the contact points.

It should be further appreciated that, in this embodiment, the antennae are both arranged on the outer surface or the inner surface of the case. However, the present disclosure is not limited thereto, and during the practical application, the antennae may also be arranged at at least one side surface of the case.

Figure 2:
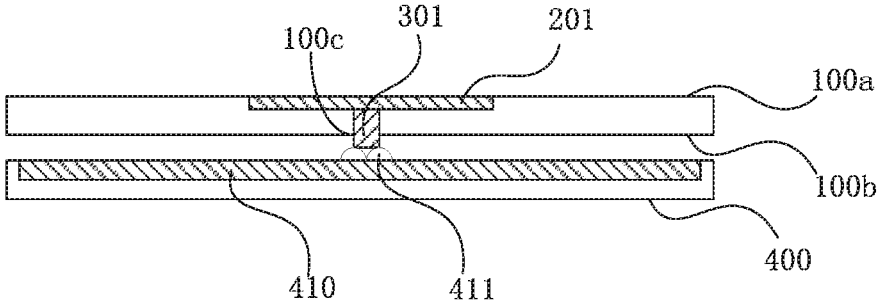
FIG. 2 is another sectional view of the mobile display terminal according to the first embodiment of the present disclosure.

Alternatively, referring to FIG. 2 which is another sectional view of the mobile display terminal, the antenna 201 (and/or antenna 202) may be arranged within the case, with a part of the antenna 201 (and/or antenna 202) being exposed at the outer surface (i.e., 100*a*) of the case. In other words, a groove may be arranged in the outer surface of the case, and the antenna 201 (and/or antenna 202) may be arranged in the groove. At this time, the antenna may be in flush with the outer surface 100*a* of the case, or protruded from or depressed inward the outer surface 100*a* of the case.

Figure 3:
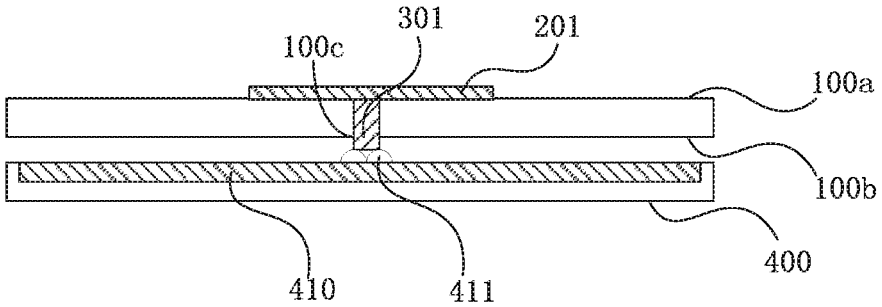
FIG. 3 is yet another sectional view of the mobile display terminal according to the first embodiment of the present disclosure.

Alternatively, referring to FIG. 3, which is yet another sectional view of the mobile display terminal, the antenna 201 (and/or antenna 202) may also be arranged on the case and located outside the case, i.e., on the outer surface 100*a* of the case. Of course, during the practical application, the antenna may also be arranged on the case and located inside the case, i.e., on the inner surface 100*b* of the case.

Second Embodiment

Figure 4A:
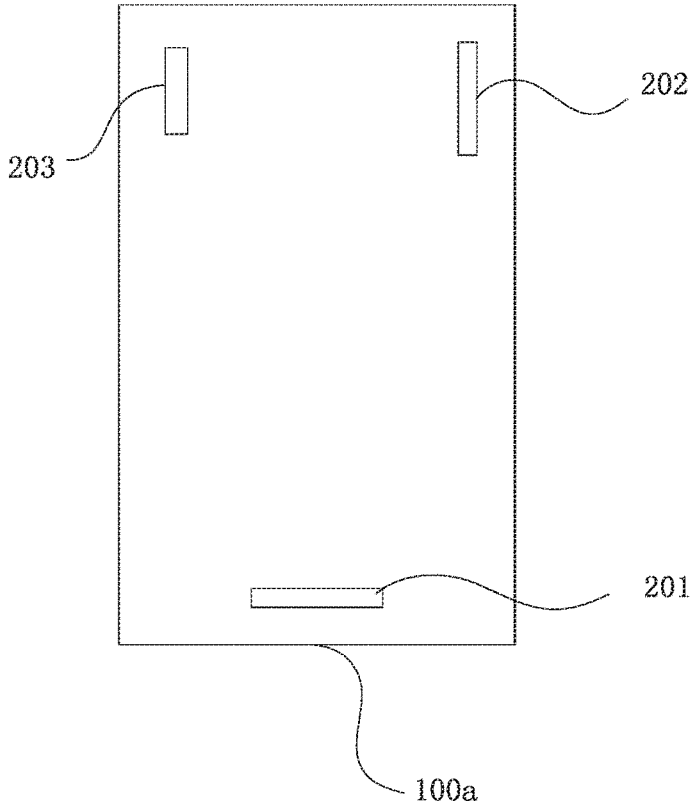
FIG. 4A is another schematic view showing the outer surface of the case of the mobile display terminal according to the second embodiment of the present disclosure.
Figure 4B:
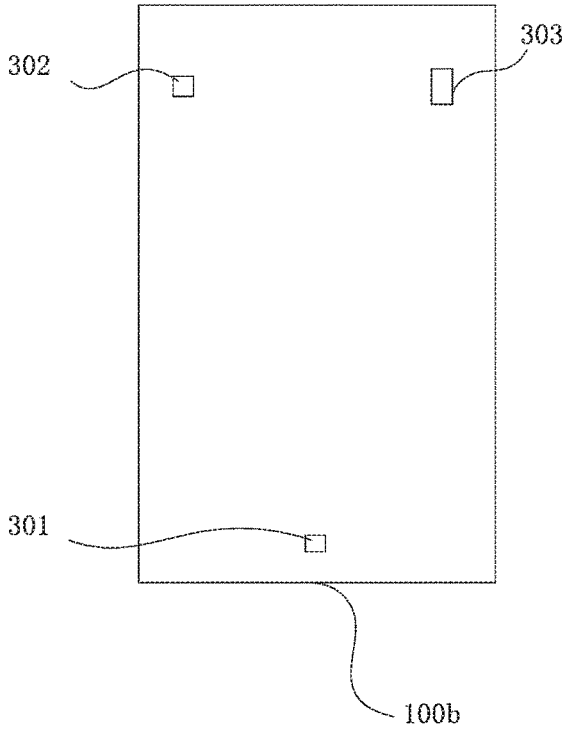
FIG. 4B is another schematic view showing the inner surface of the case of the mobile display terminal according to the second embodiment of the present disclosure.
Figure 4C:
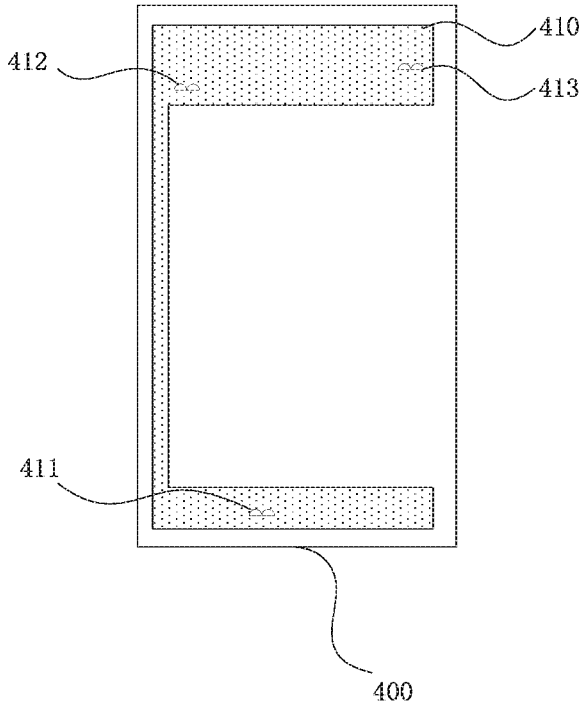
FIG. 4C is another schematic view showing the main board of the mobile display terminal according to the second embodiment of the present disclosure.

Referring to FIGS. 4A-4C, this embodiment differs from e first embodiment merely in that there are three antennae, i.e., a global positioning system (GPS) antenna 203 is added. Accordingly, an additional connector 303 is arranged at a position of the case corresponding to the GPS antenna 203, and an additional contact point 413 is arranged at a position of the circuit board 410 corresponding to the connector 303. The connector 303 is electrically connected to the circuit board 410 through the contact point 413, so as to electrically connect the GPS antenna 203 to the circuit board 410.

Of course, during the practical application, the amount and sizes of the antenna may be set randomly in accordance with a strength of the received signal or a frequency band thereof. In addition, the amount and positions of both the connectors and the contact points may correspond to the amount and positions of the antennae.

Third Embodiment

Figure 5A:
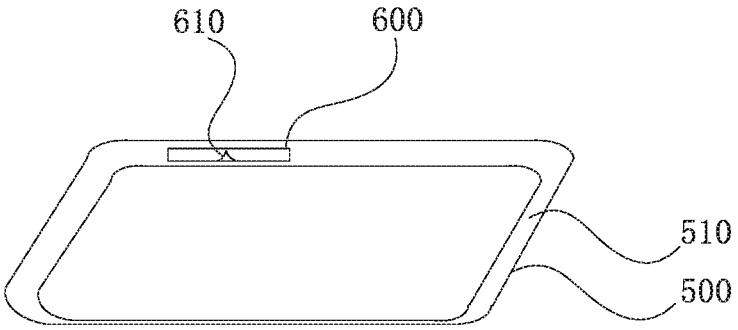
FIG. 5A is a schematic view showing the case of the mobile display terminal according to the third embodiment of the present disclosure.
Figure 5B:
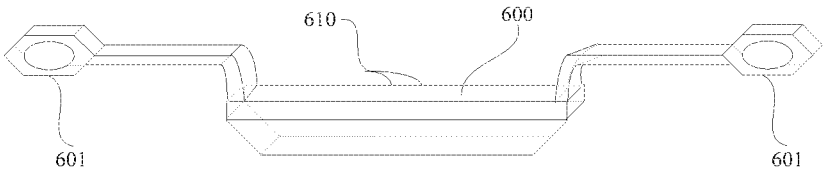
FIG. 5B is a schematic view showing a functional button in FIG. 5A.
Figure 5C:
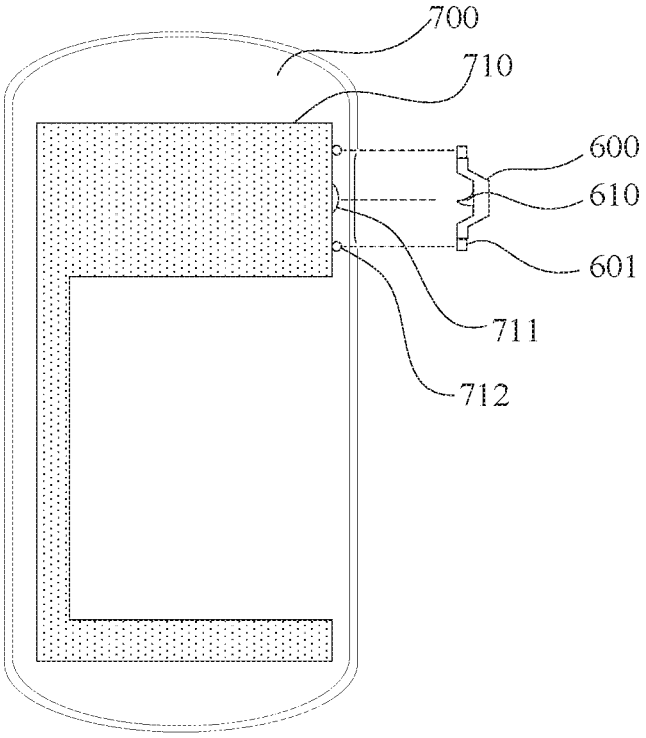
FIG. 5C is an assembly diagram of the mobile display terminal according to the third embodiment of the present disclosure.

Referring to FIGS. 5A-5C, the mobile display terminal in this embodiment includes a case 500, a main board 700 and a connector. A circuit board 710 is arranged on the main board 700, and a functional button 600 is further arranged on the case 500 and configured to be pressed by a user so as to control the mobile display terminal manually. For example, the functional button 600 may be an external functional button, such as a volume button or a power button.

In this embodiment, the functional button 600 further serves as an antenna, and the connector is an elastic member 610 capable of generating elastic deformation. For example, the elastic member 610 may be an elastic sheet or a spring and so on. In addition, the elastic member 610 is arranged on the functional button 600, so as to electrically connect the antenna (i.e., the functional button 600) to the circuit board 710 all the time when the functional button 600 is pressed or restored to its initial state.

Furthermore, as shown in FIG. 5B, the functional button 600 includes a body (a middle portion of the functional button 600), and two positioning members 601 arranged at two sides of the body respectively. When the body is mounted onto the case, each positioning member 601 is protruded from an inner surface of the body toward the main board 700 (i.e., protruded inwardly), and as shown in FIG. 5C, each positioning member 601 has an installation hole. Accordingly, two positioning columns 712 are arranged at positions of the circuit board 710 corresponding to the installation holes of the positioning members 601 respectively. When the positioning columns 712 are inserted into the respective installation holes, it is able to secure the functional button 600 onto the circuit board 710.

Because each positioning member 601 is protruded from the inner surface of the body toward the main board 700 (i.e., protruded inwardly), there is a gap between the body and the circuit board 710. The elastic member 610 is arranged on the body and within the gap. In addition, a contact point 711 is arranged at a position of the circuit board 710 corresponding to the elastic member 610, and the elastic member 610 is electrically connected to the circuit board 710 via the contact point 711, so as to electrically connect the antenna to the circuit board 710.

It should be appreciated that, during the practical application, the structure of the functional button and the way to connect the functional button with the circuit board may be set in accordance with the practical need, which is not particularly defined herein.

To sum up, according to the mobile display terminal in the embodiments of the present disclosure, the antenna is arranged on the case and electrically connected to the circuit board through the connector. As a result, the space for the antenna inside the mobile phone may be saved, so as to reduce the design difficulty, and prevent the occurrence of the electromagnetic interference between the antenna and the wires of the circuit board, thereby to improve the reception of the signals.

It should be appreciated that, the above are merely the preferred embodiments of the present disclosure. A person skilled in the art may make further modifications and improvements without departing from the spirit of the present disclosure, and these modifications and improvements shall also fall within the scope of the present disclosure.

What is claimed is:

1. A mobile display terminal, comprising a case, a main board, a first antenna and a second antenna, wherein the main board is arranged inside a cavity defined by the case, a circuit board is arranged on the main board, the first antenna is integrally formed with the case, and the mobile display terminal further comprises a connector configured to electrically connect the first antenna and the second antenna to the circuit board, wherein the connector comprises a first connector and a second connector;

wherein a hole is arranged in the case, a portion of the first antenna is arranged on an outer surface of the case, and an orthographic projection of the portion of the first antenna on the outer surface of the case onto the main board is at least partially overlapped with an orthographic projection of the hole onto the main board;

wherein the first connector is within the hole, and an orthographic projection of the first connector onto the main board overlaps the orthographic projection of the portion of the first antenna on the outer surface of the case onto the main board;

wherein the second antenna serves as a functional button;

the functional button comprises a body and positioning members, and the second connector is connected to the body;

the functional button is configured to be pressed by a user to control the mobile display terminal manually; and the second antenna is electrically connected to the circuit board through the second connector which is an elastic member capable of generating elastic deformation and arranged on the functional button;

wherein the positioning members are arranged at two sides of the body respectively, each positioning member comprises an installation hole, each positioning member is protruded from an inner surface of the body toward the main board, and positioning columns are arranged at positions of the circuit board corresponding to the installation holes of the positioning members, respectively;

an elastic deformation direction of the elastic member is parallel with the circuit board, an extending direction of each installation hole is perpendicular to the elastic deformation direction of the elastic member, and an extending direction of each positioning column is perpendicular to the elastic deformation direction of the elastic member.

2. The mobile display terminal according to claim 1, wherein the first connector is inserted into the hole and electrically connected to the first antenna.

3. The mobile display terminal according to claim 2, wherein a portion of the first antenna is arranged within the case, and the hole extends from an inner surface of the case to an interior of the case.

4. The mobile display terminal according to claim 2, wherein a portion of the first antenna is arranged within the case, with at least a part of the first antenna being exposed at an outer surface of the case, and the hole extends from the inner surface of the case to the interior of the case or penetrates through the case.

5. The mobile display terminal according to claim 1, wherein the circuit board is arranged at a side of the main board adjacent to the inner surface of the case.

6. The mobile display terminal according to claim 1, wherein a contact point is arranged at a position of the circuit board corresponding to the first connector, and the first connector is electrically connected to the circuit board via the contact point.

7. The mobile display terminal according to claim 6, wherein an amount and positions of the contact points correspond to an amount and positions of the first antenna and the second antenna, respectively.

8. The mobile display terminal according to claim 1, wherein the first antenna is arranged at at least one side surface of the case, and the second antenna is arranged at at least one side surface of the case.

9. The mobile display terminal according to claim 1, wherein the second connector is a spring.

* * * * *